United States Patent [19]

Haberman

[11] 4,398,597

[45] Aug. 16, 1983

[54] MEANS AND METHOD FOR PROTECTING APPARATUS SITUATED IN A BOREHOLE FROM CLOSURE OF THE BOREHOLE

[75] Inventor: John P. Haberman, Houston, Tex.

[73] Assignee: Texaco Inc., White Plains, N.Y.

[21] Appl. No.: 229,697

[22] Filed: Jan. 29, 1981

[51] Int. Cl.[3] ..... E21B 36/04

[52] U.S. Cl. ..... 166/57; 166/248; 166/302; 166/65 R

[58] Field of Search ..... 166/57-62, 166/248, 187, 302, 64, 65 R, 65 M, 66; 277/34

[56] References Cited

U.S. PATENT DOCUMENTS

| | | | |
|---|---|---|---|
| 385,600 | 7/1888 | Durbrow | 277/34 |
| 2,629,446 | 2/1953 | Freling et al. | 277/34 |
| 2,681,706 | 6/1954 | Pottorf | 166/187 |
| 2,696,258 | 12/1954 | Greene | 166/187 |
| 2,935,615 | 5/1960 | True | 166/187 |
| 3,982,591 | 9/1976 | Hamrick et al. | 166/64 X |
| 4,125,289 | 11/1978 | Huff et al. | 166/57 X |
| 4,196,329 | 4/1980 | Rowland et al. | 166/248 |
| 4,301,865 | 11/1981 | Kasevich et al. | 166/65 R X |

*Primary Examiner*—Ernest R. Purser
*Assistant Examiner*—Thuy M. Bui
*Attorney, Agent, or Firm*—Carl G. Ries; Robert A. Kulason; Ronald G. Gillespie

[57] ABSTRACT

Apparatus situated in a borehole traversing an earth formation is protected from closure of the borehole by being encased in an inflatable device. Surface equipment inflates and maintains the inflatable device at a sufficient pressure so as to prevent the earth formation from closing in and contacting the apparatus.

8 Claims, 2 Drawing Figures

MEANS AND METHOD FOR PROTECTING APPARATUS SITUATED IN A BOREHOLE FROM CLOSURE OF THE BOREHOLE

BACKGROUND OF THE INVENTION

Field of the Invention

The present invention relates to means and methods for use in a borehole traversing an earth formation and, more particularly, for protecting apparatus located within said borehole.

SUMMARY OF THE INVENTION

Apparatus situated in a borehole traversing an earth formation is protected from a closing of the borehole by an inflatable device. The device encompasses the apparatus and is inflated, to maintain a minimum open space, by equipment located at the surface of the borehole.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Large hydrocarbon reserves exist in the form of oil shale deposits if some economical means could be found to break it down into an extractable liquid and to produce it from wells in the deposit. Radio frequency heating of the deposits as shown in U.S. Pat. No. 4,196,329, issued Apr. 1, 1980, heats the oil shale deposit until pyrolysis occurs converting the kerogen in the oil shale deposit to shale oil and other hydrocarbons. One problem encountered with such an in-situ technique for producing hydrocarbons occurs during the heating of the oil shale, the rock tends to close the borehole in which the antenna is suspended, thereby either damaging the antenna or shorting out the antenna, shutting down the operation. The present invention alleviates this problem.

Figure 1:
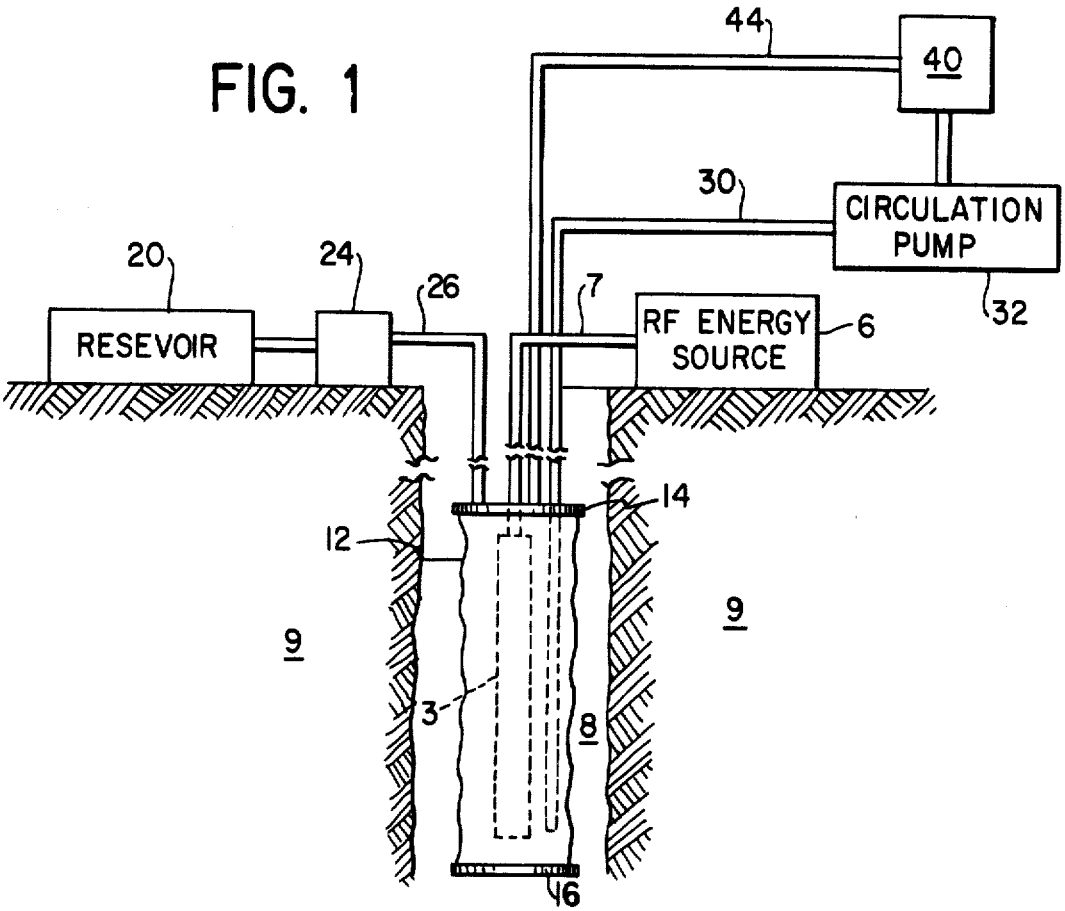
FIG. 1 shows in partial schematic form and partial block diagram form a system constructed in accordance with the present invention for protecting apparatus in a borehole from a closing of the borehole.
Figure 2:
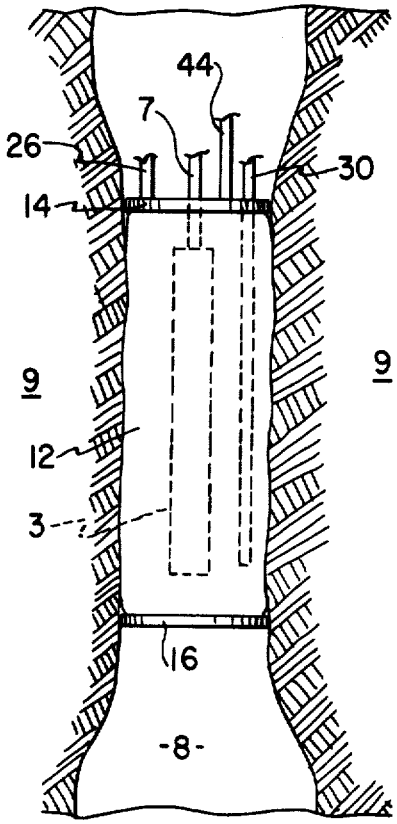
FIG. 2 is a schematic diagram showing the sleeve shown in FIG. 1 in an inflated condition.

With reference to FIG. 1, an RF antenna 3 receives RF energy from a source 6 for radiation in a borehole 8 to an oil shale deposit 9. A sleeve 12 cooperates with end pieces 14 and 16 to protect antenna 3 as hereinafter explained. Sleeve 12 is made from flexible, non-conductive material such as rubber. It should be noted that if the present invention is used to protect other downhole apparatus instead of an RF antenna, the non-conductive restriction may be dropped depending on the apparatus being protected. End piece 14 is especially adapted to pass the transmission apparatus for the RF energy to the antenna and for other piping as hereinafter explained. A reservoir 20 contains a fluid which may be a hydraulic liquid or gas which is pumped into the chamber formed by sleeve 12 and end pieces 14 and 16 by a hydraulic pump 24 through a line 26. The hydraulic fluid in sleeve 12 causes it to expand to form at least the same diameter as that of the end pieces 14 and 16. As the formation continues to press in, the pressure of the hydraulic fluid is increased so as to maintain sufficient clearance for the antenna 3.

As the hydraulic fluid in sleeve 12 heats up, it is cooled by circulation through a line 30 to a circulation pump 32 which provides it to a heat exchanger 40 for cooling and returns to sleeve 12 by way of a line 44 so as to cool sleeve 12.

The present invention may also be used to maintain the earth formation at a predetermined temperature by controlling the temperature of the hydraulic fluid when sleeve 12 is in contact with the earth formation. The temperature of the hydraulic fluid as hereinbefore described is controlled by heat exchanger 40 to maintain the predetermined temperature.

The device of the present invention is designed to protect apparatus in a borehole traversing an earth formation from damage due to expansion of the earth formation or to a non-intentional closure of the borehole.

What is claimed is:

1. An improvement to an apparatus for the in-situ recovery of hydrocarbons from an oil shale deposit wherein an RF antenna is entered into a borehole traversing the oil shale deposit and is energized so as to heat the oil shale deposit, comprising
   - inflatable, non-conductive means encompassing said RF antenna for protecting the antenna, and
   - means for inflating said inflatable means so as to prevent portions of the heated oil shale deposit from contacting said RF antenna.

2. An improvement as described in claim 1 in which the inflating means includes
   - a source of hydraulic fluid, and
   - pump means connected to said reservoir and to said inflatable means for pumping the hydraulic fluid to the inflatable means so as to inflate it.

3. An improvement as described in claim 2 in which the inflatable means includes
   - a flexible, non-conductive member means for being extended by hydraulic fluid,
   - a first end piece means for sealing one end of the flexible means, and
   - a second end piece means for sealing the other end of the flexible member means which is adapted to have an RF energy conduit to pass through it so that said conduit is connected to the RF antenna located within said inflatable means and to pass hydraulic fluid through it to the flexible member means.

4. An improvement as described in claim 3 further comprising
   - means for preventing the overheating of the inflatable means.

5. A system as described in claim 4 in which the preventing means includes
   - means for circulating said hydraulic fluid, and
   - means for cooling said circulating hydraulic fluid so as to prevent the inflatable means from overheating.

6. An improvement as described in claim 5 in which the hydraulic fluid is a liquid.

7. An improvement as described in claim 5 in which the hydraulic fluid is a gas.

8. A system for controlling the temperature of a portion of an earth formation traversed by a borehole comprising means for providing heat in the borehole to the earth formation, inflatable means encompassing said heating means for being inflated so that it contacts the earth formation, means for inflating said inflatable means with hydraulic fluid, and means for maintaining the hydraulic fluid at a predetermined temperature so as to control the temperature of the heated earth formation.

* * * * *